US009291159B2

(12) United States Patent
Baxter

(10) Patent No.: US 9,291,159 B2
(45) Date of Patent: Mar. 22, 2016

(54) PUMP HEAD WITH INDEPENDENTLY SPRUNG OFFSET PICOTING ROLLERS

(71) Applicant: Alcon Research, Ltd., Fort Worth, TX (US)

(72) Inventor: Vincent A. Baxter, Temecula, CA (US)

(73) Assignee: Novartis AG, Basel (CH)

( * ) Notice: Subject to any disclaimer, the term of this patent is extended or adjusted under 35 U.S.C. 154(b) by 239 days.

(21) Appl. No.: 13/905,221

(22) Filed: May 30, 2013

(65) Prior Publication Data

US 2014/0356205 A1 Dec. 4, 2014

(51) Int. Cl.
*F04B 43/12* (2006.01)

(52) U.S. Cl.
CPC ..... *F04B 43/1269* (2013.01); *F04B 43/12* (2013.01); *F04B 43/1253* (2013.01); *F04B 43/1276* (2013.01)

(58) Field of Classification Search
CPC ..... F04B 43/1269; F04B 43/1253; F04B 43/1276
USPC ..... 417/477.5
See application file for complete search history.

(56) References Cited

U.S. PATENT DOCUMENTS

| | | | | | |
|---|---|---|---|---|---|
| 612,834 | A | * | 10/1898 | Dieckmann | 417/477.5 |
| 1,659,238 | A | | 2/1928 | Boyce | |
| 2,671,412 | A | | 3/1954 | Rand | |
| 2,722,893 | A | | 11/1955 | Maillot | |
| 3,192,863 | A | | 7/1965 | Vadot | |
| 3,403,668 | A | | 10/1968 | Schottler | |
| 3,644,068 | A | * | 2/1972 | Lepak | 417/477.7 |
| 3,822,948 | A | * | 7/1974 | Handl | 401/146 |
| 3,927,955 | A | * | 12/1975 | Spinosa et al. | 417/477.3 |
| 3,960,466 | A | * | 6/1976 | Taylor | 417/234 |
| 3,963,023 | A | | 6/1976 | Hankinson | |
| 4,363,609 | A | | 12/1982 | Cosentino et al. | |
| 4,392,794 | A | | 7/1983 | Foxcroft | |
| 4,441,867 | A | * | 4/1984 | Berelson | 417/475 |
| 4,484,864 | A | | 11/1984 | Michel | |
| 4,564,342 | A | * | 1/1986 | Weber et al. | 417/477.6 |
| 5,533,878 | A | | 7/1996 | Iwata | |
| 5,759,017 | A | * | 6/1998 | Patton et al. | 417/477.9 |

(Continued)

FOREIGN PATENT DOCUMENTS

| | | | | |
|---|---|---|---|---|
| GB | 2051253 | A * | 1/1981 | F04B 43/12 |

OTHER PUBLICATIONS

PCT/US2014/023104, "International Search Report", International Searching Authority, Jul. 1, 2014, 2 pgs.

(Continued)

*Primary Examiner* — Bryan Lettman
*Assistant Examiner* — Christopher Bobish
(74) *Attorney, Agent, or Firm* — Kenneth D. Bassinger

(57) ABSTRACT

A roller assembly comprises a central section with a hub, the central section having a plurality of pivots located around the central section; a plurality of arms, each arm having a roller end and a pivot end, the pivot ends coupled to the central section at the plurality of pivots such that each arm is capable of pivoting independently with respect to the central section, the roller ends and pivot ends of each arm located a distance of at least one roller width away from each other; a plurality of rollers, one roller coupled to each of the roller ends of the plurality of arms; wherein the plurality of rollers and arms are located around the central section such that the pivot is located a distance away from the roller.

19 Claims, 16 Drawing Sheets

(56) References Cited

U.S. PATENT DOCUMENTS

| | | | | |
|---|---|---|---|---|
| 6,168,397 | B1 | 1/2001 | Iwata | |
| 6,186,014 | B1 | 2/2001 | Kato | |
| 6,296,460 | B1 | 10/2001 | Smith | |
| 6,645,176 | B1 * | 11/2003 | Christenson et al. | 604/151 |
| 6,743,204 | B2 | 6/2004 | Christenson et al. | |
| 6,860,167 | B2 | 3/2005 | Schmidt et al. | |
| 2006/0245964 | A1 | 11/2006 | Koslov et al. | |
| 2008/0131300 | A1 | 6/2008 | Junod et al. | |
| 2009/0269228 | A1 | 10/2009 | McIntosh | |
| 2010/0047100 | A1 | 2/2010 | Kojima et al. | |
| 2010/0286651 | A1 | 11/2010 | Sorensen | |
| 2010/0316516 | A1 | 12/2010 | Vidal | |
| 2012/0020822 | A1 | 1/2012 | Richardson et al. | |
| 2014/0356203 | A1 * | 12/2014 | Baxter | 417/477.1 |

OTHER PUBLICATIONS

PCT/US2014/023104, "Written Opinion", International Searching Authority, Jul. 1, 2014, 4 pgs.

International Searching Authority, International Preliminary Report on Patentability, PCT/US2014/023104, Mailed Dec. 1, 2015, 5 pages.

* cited by examiner

PUMP HEAD WITH INDEPENDENTLY SPRUNG OFFSET PICOTING ROLLERS

BACKGROUND OF THE INVENTION

The present invention generally pertains to pumps. More particularly, but not by way of limitation, the present invention pertains to peristaltic pumps.

Peristaltic pumps may be used in many different applications including delivery of fluid during surgical applications (e.g., ophthalmic surgical applications). Peristaltic pumps may operate by compressing a length of tubing to move a fluid in the tubing or squeeze a molded flow channel between an elastomeric sheet and a rigid substrate to move a fluid between the elastomeric sheet and the rigid substrate. Rotating roller heads applied against the tubing or elastomeric sheet may be used for compressing the tubing or elastomeric sheet. While peristaltic pumps may provide predictable flow properties, they may also impart unwanted flow and pressure pulsations. In addition, the rotating roller heads may fail to properly compress the tubing or elastomeric sheet. It would be desirable to have a peristaltic pump roller assembly that overcomes these problems.

SUMMARY OF THE INVENTION

In one embodiment of the present invention, a roller assembly comprises a central section with a hub; a plurality of arms coupled to the central section, each arm having a radial section, an arcuate section, and a bent section; and a plurality of rollers, one roller coupled to the bent section of each arm. The arms may be flexible such that the rollers are capable of moving with respect to the central section when the arms flex. The roller may be coupled to the bent section with a pin. The arms and the rollers are distributed around the hub. A rolling surface of the rollers is generally parallel with a flat surface of the central section. The rolling surface of the rollers is arranged to engage a polymer sheet or flexible tubing throughout travel of the arms. The central section and arms may be cut from a single sheet of material. In addition, the central section may comprise a first flat surface, the radial section of the arm may comprise a second flat surface, and the axial section of the arm may comprise a fourth flat surface in which the first flat surface generally parallel to the second and third flat surfaces. Further, the bent section may comprise a fourth flat surface, the fourth flat surface arranged at an angle of between 900 and 140 degrees with respect to the first, second and third flat surfaces. The roller may be coupled to the bent section via a pin and cap pin In another embodiment of the present invention, a roller assembly for use with a peristaltic pump system comprises a central section with a hub; a plurality of arms coupled to the central section, each arm having a radial section, an arcuate section, and a bent section; a plurality of rollers, one roller coupled to the bent section of each arm; wherein the central section comprises a first flat surface, the radial section of the arm comprises a second flat surface, and the axial section of the arm comprises a fourth flat surface, the first flat surface generally parallel to the second and third flat surfaces, and further wherein the bent section comprises a fourth flat surface, the fourth flat surface arranged at an angle with respect to the first, second and third flat surfaces.

In another embodiment of the present invention, a roller assembly comprises a central section with a hub; a plurality of flexible arms coupled to the central section; a plurality of spring pins, one spring pin coupled to each of the plurality of flexible arms; a plurality of arms coupled to the central section such that each arm is capable of pivoting independently with respect to the central section; and a plurality of rollers, one roller coupled to each of the plurality of arms. The roller may be coupled to the arm with a pin. The arms and the rollers may be distributed around the hub. A rolling surface of the rollers is generally parallel with a flat surface of the central section. The arm has a stop located at an end of the arm, the stop engages the central section to limit a range of pivoting motion of the arm. The arm may be coupled to a pivot, the pivot located adjacent to the stop. Each of the plurality of arms may have a flat that contacts the plurality of spring pins. The spring pin exerts a force on the flat, the force provided by the flexible arm. The spring pin presses on the flat to bias the arm in an unpivoted position whereby the stop contacts the central section. The plurality of flexible arms and a top surface of the central section may be formed from single sheet of material. The rolling surface of the rollers may be arranged to engage a polymer sheet or flexible tubing throughout a range of travel of the arms.

In another embodiment of the present invention, a roller assembly comprises a central section with a hub; a plurality of flexible arms coupled to the central section; a plurality of spring pins, one spring pin coupled to each of the plurality of flexible arms; a plurality of arms coupled to the central section such that each arm is capable of pivoting independently with respect to the central section, each arm having a pivot located adjacent to a stop; and a plurality of rollers, one roller coupled to each of the plurality of arms; wherein each spring pin exerts a force on an associated arm, the force provided by an associated flexible arm so as to bias the arm in a nonpivoted position.

In another embodiment of the present invention, a roller assembly comprises a central section with a hub; a plurality of spring assemblies coupled to the central section; a plurality of arms coupled to the central section such that each arm is capable of pivoting independently with respect to the central section; and a plurality of rollers, one roller coupled to each of the plurality of arms. Each roller may be coupled to each arm with a pin. The arms and the rollers may be distributed around the hub. A rolling surface of the rollers is generally parallel with a flat surface of the central section. Each of the plurality of arms may have a stop located at an end of each arm, each stop engages the central section to limit a range of pivoting motion of each arm. Each of the plurality of arms may be coupled to a pivot, the pivot located adjacent to the stop. Each spring assembly further comprises a spring pin. Each of the plurality of arms may have a flat that contacts the plurality of spring pins. Each spring pin exerts a force on each flat, the force provided by each spring assembly. Each spring pin presses on each flat to bias each arm in an unpivoted position in which each stop contacts the central section. The rolling surface of the rollers is arranged to engage a polymer sheet or flexible tubing throughout a range of travel of the arms.

In another embodiment of the present invention. a roller assembly comprises a central section with a hub; a plurality of spring assemblies coupled to the central section; a plurality of spring pins, one spring pin coupled to each of the plurality of spring assemblies; a plurality of arms coupled to the central section such that each arm is capable of pivoting independently with respect to the central section, each arm having a pivot located adjacent to a stop; and a plurality of rollers, one roller coupled to each of the plurality of arms; wherein each spring pin exerts a force on an associated arm, the force provided by an associated spring assembly so as to bias the arm in a nonpivoted position.

In another embodiment of the present invention, a roller assembly comprises a central section with a hub; a plurality of arms coupled to the central section such that each arm is capable of moving independently with respect to the central section; a plurality of spring pins, one spring pin associated with each arm; a plurality of retaining pins, one retaining pin associated with each arm; and a plurality of rollers, one roller coupled to each arm. The roller may be coupled to the arm via an axle and a pin. The arms and the rollers may be distributed around the hub. A rolling surface of the roller may be generally parallel to a flat surface of the central section. A plurality of springs may be located around the plurality of spring pins, each spring located between each arm and the central section. The spring pin may be located in a first bore in the central section, the retaining pin may be located in a second bore in the central section, the spring pin may be fixed to the arm, and the retaining pin may be fixed to the central section. The roller may be constrained by the retaining pin and the spring pin to move along an axis defined by the retaining pin. The spring exerts a force on each arm thereby biasing each arm away from the central section. One end of the spring may be located in a recess in the central section and the other end of the spring may be located in a recess in the arm. The rolling surface of the rollers may be arranged to engage a polymer sheet or flexible tubing throughout a range of travel of the arms.

In another embodiment of the present invention, a roller assembly comprises a central section with a hub; a plurality of arms coupled to the central section such that each arm is capable of moving independently with respect to the central section; a plurality of spring pins located is a plurality of first bores in the central section, one spring pin fixed to each arm; a plurality of retaining pins located in a plurality of second bores in the central section and fixed to the central section, one retaining pin associated with each arm; and a plurality of rollers, one roller coupled to each arm; wherein the rollers are constrained by the retaining pins and the spring pins to move along an axis defined by the retaining pins.

In another embodiment of the present invention, a roller assembly comprises a central section with a hub, the central section having a plurality of pivots located around the central section; a plurality of arms, each arm having a roller end and a pivot end, the pivot ends coupled to the central section at the plurality of pivots such that each arm is capable of pivoting independently with respect to the central section, the roller ends and pivot ends of each arm located a distance of at least one roller width away from each other; a plurality of rollers, one roller coupled to each of the roller ends of the plurality of arms; wherein the plurality of rollers and arms are located around the central section such that the pivot is located a distance away from the roller. Each roller may be coupled to each arm via an axle and a pin. A rolling surface of the rollers may be generally parallel with a flat surface of the central section. A plurality of springs may be located adjacent to each roller. The plurality of springs may be located in a plurality of spring bores in the central section. Each arm further comprises a pair of pivot pins, the pair of pivot pins coupling the arm to the central section at the pivot. Each arm further comprises a hub retaining surface and a spring coupling surface located near the roller arm end of the arm. The spring coupling surface contacts the spring. The hub retaining surface contacts the hub such that the hub retains the arm adjacent to the central section. When an arm pivots, a roller surface of the roller coupled to the arm is generally parallel to a surface of the central section. The plurality of pivots may be located around a periphery of the central section. The rollers are located interior the periphery of the central section. A rolling surface of the rollers is arranged to engage a polymer sheet or flexible tubing throughout a range of travel of the arms.

In another embodiment of the present invention, a roller assembly comprises a central section with a hub, the central section having a plurality of pivots located around the central section; a plurality of arms, each arm having a roller arm end and a pivot end, the pivot ends coupled to the central section at the plurality of pivots such that each arm is capable of pivoting independently with respect to the central section, the roller arm ends and pivot ends of each arm located a distance of at least one roller width away from each other; a hub retaining surface and a spring coupling surface located near the roller arm end of the arm; a plurality of rollers, one roller coupled to each of the roller ends of the plurality of arms; and a plurality of springs, one spring located adjacent to each roller; wherein the plurality of rollers and arms are located around the central section such that the pivot is located a distance away from the roller, the spring coupling surface contacts the spring, and the hub retaining surface contacts the hub such that the hub retains the arm adjacent to the central section.

BRIEF DESCRIPTION OF THE DRAWINGS

The accompanying drawings, which are incorporated in and constitute a part of this specification, illustrate several embodiments of the invention and together with the description, serve to explain the principles of the invention.

It is to be understood that both the foregoing general description and the following detailed description are exemplary and explanatory only and are intended to provide a further explanation of the present invention as claimed.

DETAILED DESCRIPTION

Reference is now made in detail to the exemplary embodiments of the invention, examples of which are illustrated in the accompanying drawings. Wherever possible, the same reference numbers are used throughout the drawings to refer to the same or like parts.

Figure 1B:
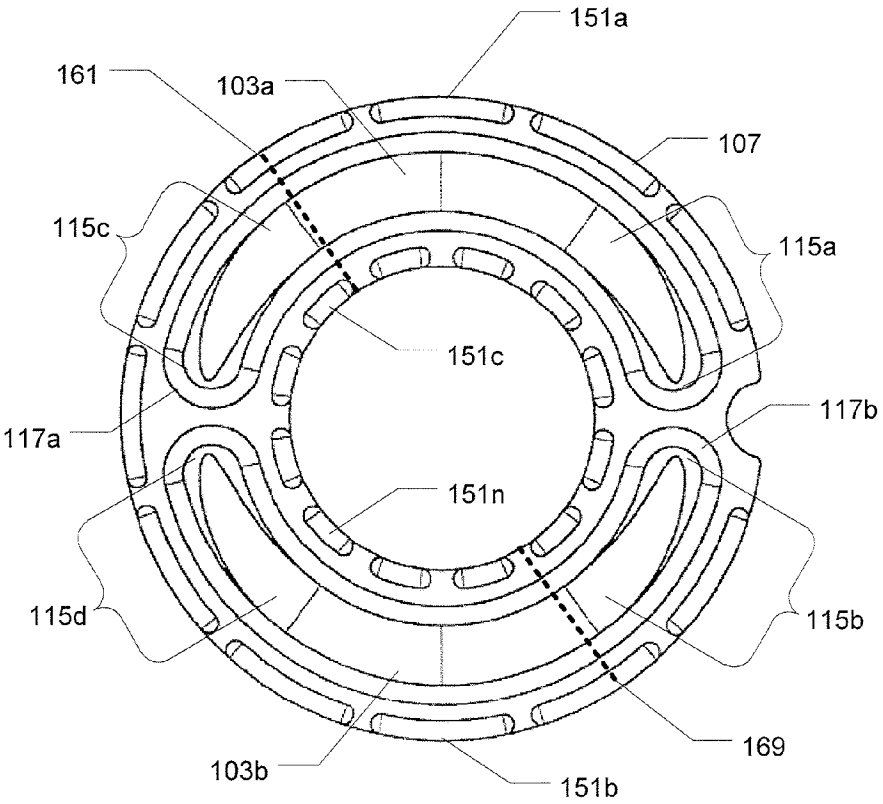
FIG. 1*b* is a back view of the elastomeric sheet with two pump segments, according to an embodiment of the present invention.
Figure 1A:
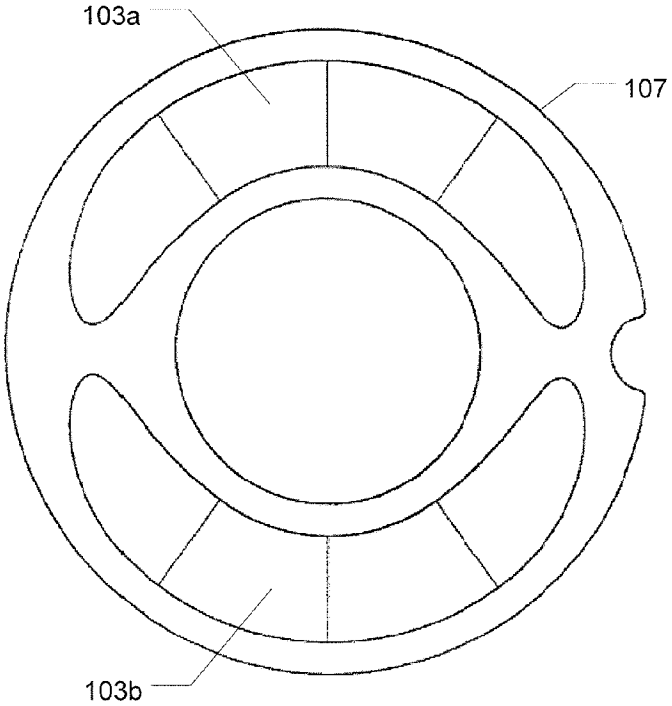
FIG. 1*a* is a front view of an elastomeric sheet with two pump segments, according to an embodiment of the present invention.
Figure 1D:
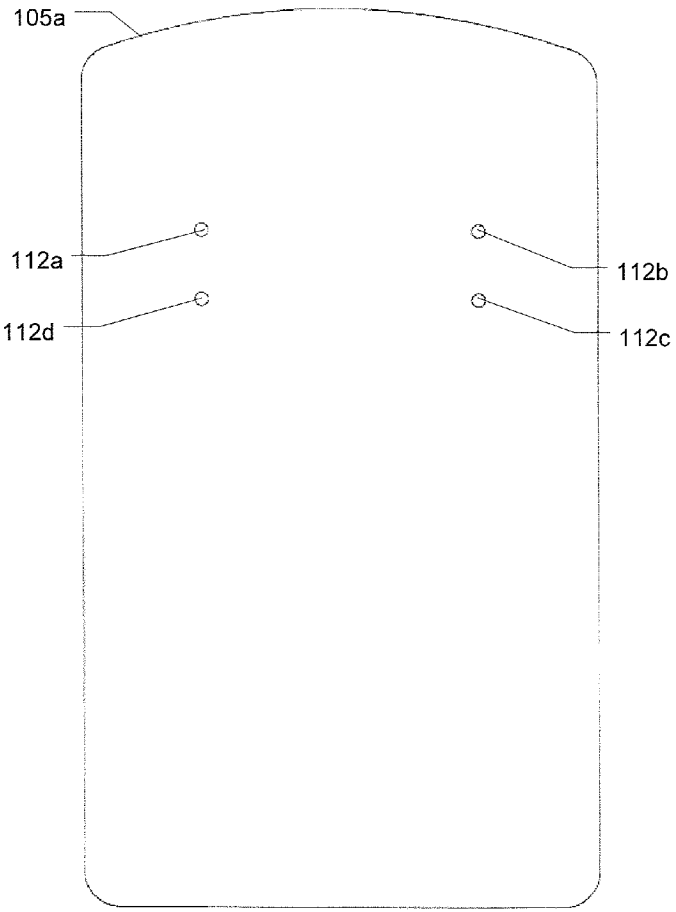
FIG. 1*d* is a back view of the substrate for two pump segments, according to an embodiment of the present invention.
Figure 1C:
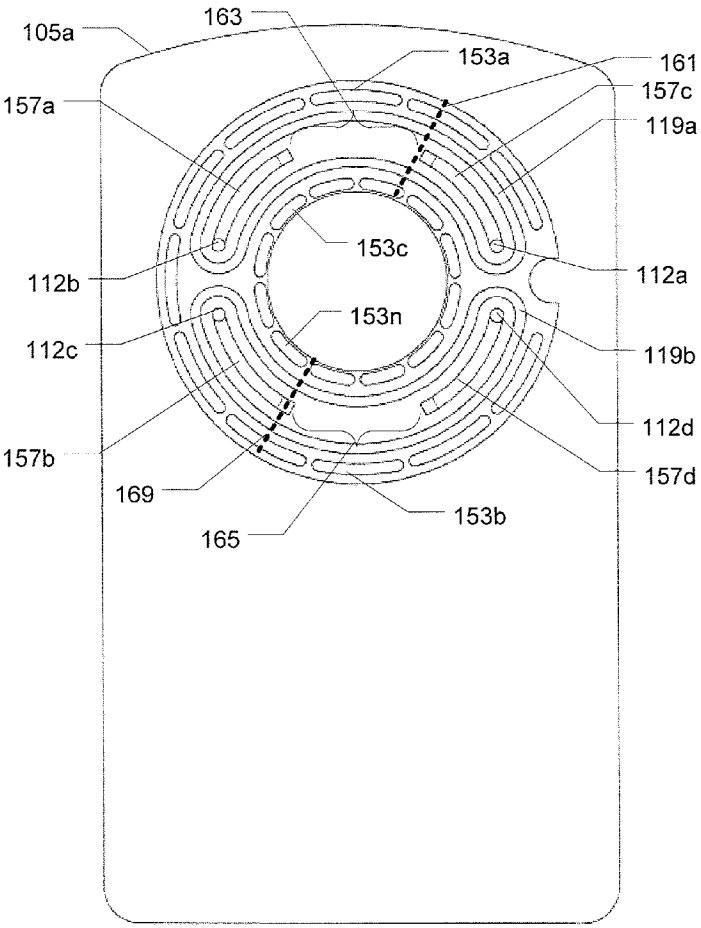
FIG. 1*c* is a front view of a substrate for two pump segments, according to an embodiment of the present invention.
Figure 2A:
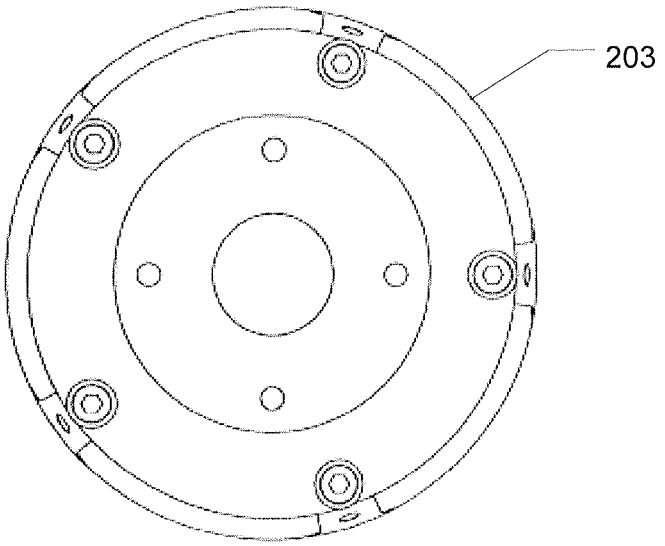
FIG. 2*a* is a top view of a roller head, according to an embodiment of the present invention.
Figure 2B:
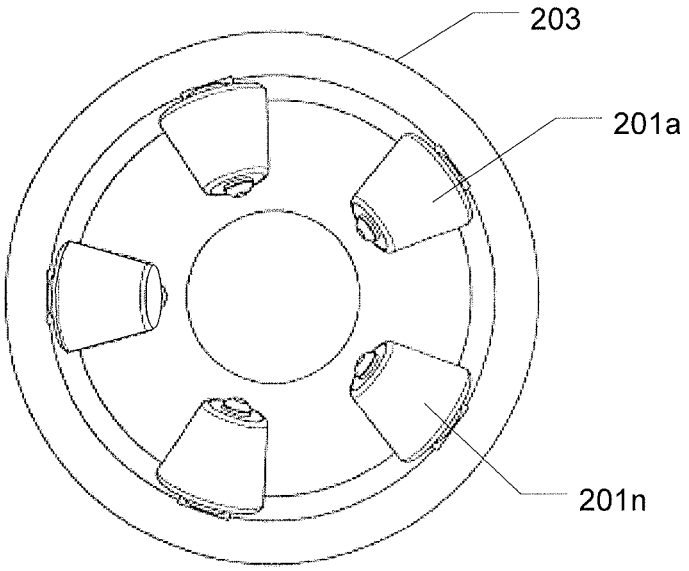
FIG. 2*b* is a bottom view of the roller head, according to an embodiment of the present invention.

FIGS. 1*a-b* illustrate a sheet 107 (such as an elastomeric sheet) for coupling to a substrate 105 (e.g., any of substrates 105*a-c*—generally referred to herein as substrate 105) to define two or more pump segments (e.g., any of pump segments 103*a-b*—generally referred to herein as pump segments 103) in a cassette 100 (e.g., any of cassettes 100*a-b*—generally referred to herein as cassette 100). Cassette 100 may use pump segments 103 to provide aspiration and/or infusion of fluid 155 (e.g., see FIG. 5*c*) for a surgical console (e.g., an ophthalmic surgical console 701 as seen in FIG. 7). FIGS. 1*c-d* illustrate an embodiment of substrate 105*a* (other embodiments of the substrate 105 are also contemplated). In various embodiments, the two or more pump segments 103 may be formed between the sheet 107 and the substrate 105 of the cassette 100. Sheet 107 may be made of a flexible, moldable material such as silicone rubber or thermoplastic elastomer. Other materials are also contemplated. Substrate 105 may be made of a material that is rigid with respect to sheet 107, such as a rigid thermoplastic, and may be made by any suitable method, such as machining or injection molding. In some embodiments, the sheet 107 may be bonded or mechanically attached to the substrate 105 (e.g., through adhesive, heat fusion, mechanical crimping, rivets, etc). In some embodiments, protrusions 151*a-n* on an outer perimeter and/or interior of sheet 107 may engage corresponding recesses 153*a-n* on substrate 105 to connect the sheet 107 to the substrate 105 and help prevent rotation of the sheet 107 when acted upon by rollers (e.g., see rollers 201*a-n* in FIG. 2*b*) (rollers 201*a-n*—generally referred to herein as rollers 201). As used herein, the label "a-n" is used to refer to the various elements in the presented embodiments for that element. For example, "rollers 201*a-n*" is used to refer to the rollers shown in, for example, FIG. 2*b* (FIG. 2*b* shows 5 rollers—the two rollers in FIG. 2*b* are labeled 201*a* and 201*n* although some of the rollers in each of these FIGs. may not have specific labels). In some embodiments, protrusions 117*a,b* (which may outline the respective pump segments 103) may fit into corresponding recesses 119*a,b* (see FIG. 3*a*). Protrusions 117*a,b* (and/or 151*a-n*) may be secured to respective recesses 119*a,b* (and/or 153*a-n*) to retain the sheet 107 to the substrate 105. In some embodiments, protrusions 117*a,b* (and/or 151*a-n*) may be secured to respective recesses 119*a,b* (and/or 153*a-n*) through a mechanical/friction fit, adhesive, heat fusion, etc. In some embodiments, protrusions 117*a,b* may be secured to respective recesses 119*a,b* to form a seal to prevent escape of a pump fluid 155 (such as BSS™ (balanced salt solution)) from the pump segments 103.

Figure 3A:
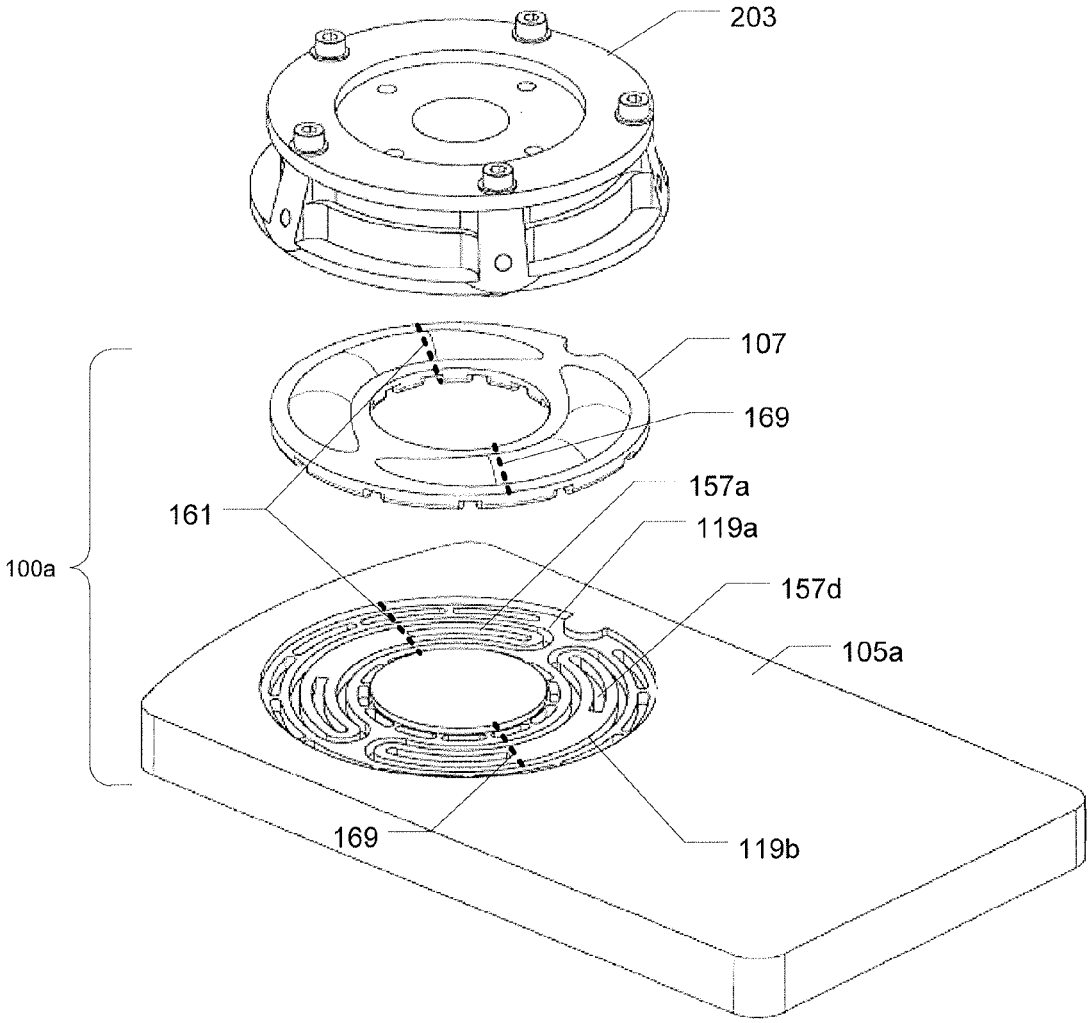
FIGS. 3*a* and 3*b* are isometric views of an expanded cassette assembly view, according to an embodiment of the present invention.
Figure 3B:
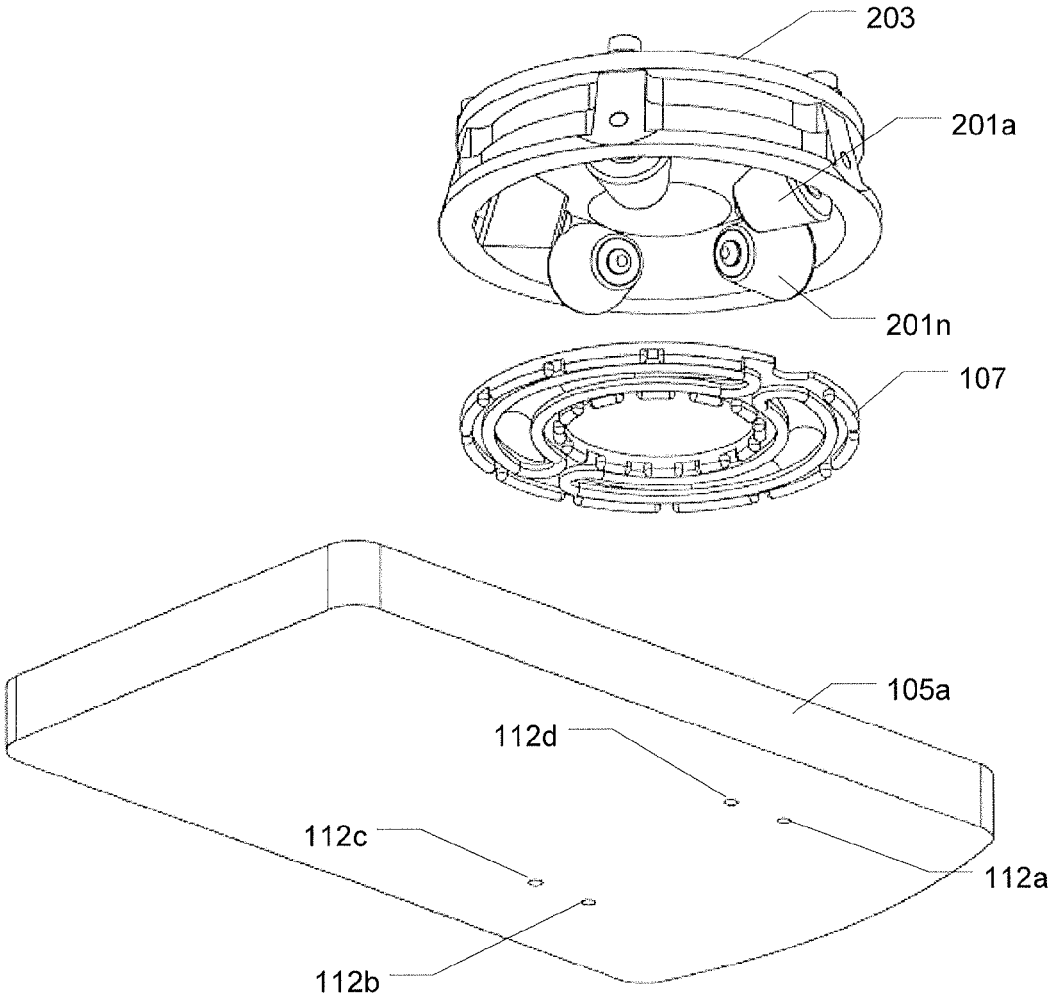
Figure 3C:
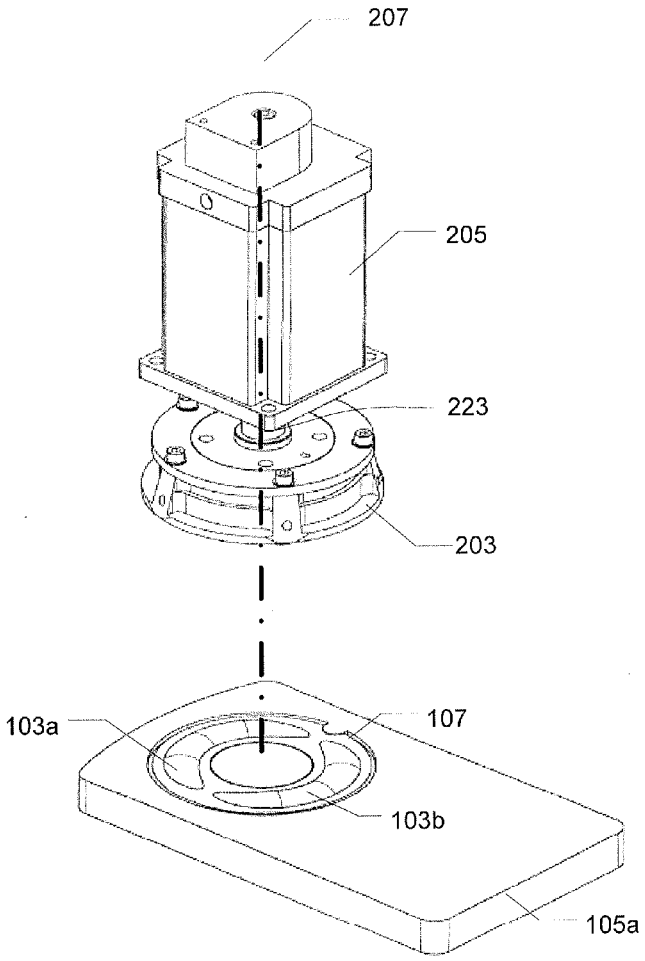
FIG. 3*c* is a side view of the roller head and motor, according to an embodiment of the present invention.
Figure 3D:
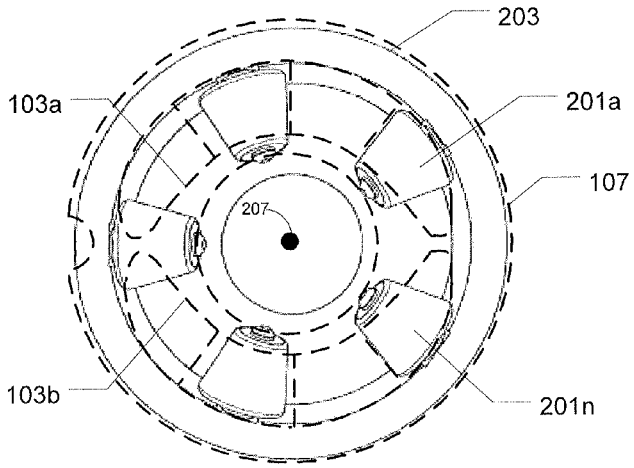
FIG. 3*d* is an outline of the roller head engaging the sheet, according to an embodiment of the present invention.

In various embodiments, fluid 155 may be pumped through the cassette 100 when a series of rollers 201 engage the two or more pump segments 103 on the cassette 100. FIGS. 2*a-b* illustrate a roller head 203 with rollers 201. FIGS. 3*a-b* illustrate isometric views of an embodiment of an expanded cassette assembly view showing the rollers 201, the sheet 107, and the substrate 105. FIG. 3*c* illustrates an embodiment of the roller head 203 and corresponding peristaltic pump motor 205. In some embodiments, the rollers 201 on the roller head 203 may be radially mounted from an axis of rotation 207 of the peristaltic pump motor 205 (e.g., a stepper or direct current (DC) servo motor, or other motor (such as an alternating current (AC) motor)) and may be configured to compress the pump segments 103 against the underlying substrate 105. The rollers 201 may be mounted to pump motor 205 through roller head 203 and shaft 223 such that pump motor 205 may rotate roller head 203 in a plane generally normal or perpendicular to axis 207 of shaft 223 (see also solid circle 207 in FIG. 3*d* showing where the axis 207 is perpendicular to the plane of the rollers 201), and the longitudinal axes of rollers 201 may be generally radial to the axis of shaft 223. FIG. 3*d* illustrates an embodiment of the rollers 201 engaging two pump segments 103*a,b* on sheet 107 (indicated in dashed lines). The two or more pump segments 103 on the cassette 100 may produce additional flow (e.g., approximately twice the flow for two segments as opposed to one) than if the cassette 100 had only one pump segment engaging the roller head 203.

In various embodiments, the two (or more) active pump segments 103 in the sheet 107 may be acted upon by a single hub roller assembly (e.g., including rollers 201 and roller head 203). As rollers 201 engage the pump segments 103, each roller may first roll over a transition region (e.g., transition regions 115*a-d*—generally referred to herein as transition region 115) with an underlying transition channel (e.g., transition channels 157*a-d*—generally referred to herein as transition channel 157). In some embodiments, the sheet 107 may not include transition regions 115 and the substrate 105 may not include transition channels 157. As the rollers 201 roll off of the transition region 115 (and correspondingly, off of the transition channel 157), the rollers 201 may form an internal seal within the pump segment 103 (e.g., at point 161 indicated with dashed lines on pump segment 103*a* and at point 169 on pump segment 103*b*) by pressing the sheet 107 fully against substrate 105 at the seal point (in the absence of transition regions and transition channels, the roller 201 may form a seal at the start of the roller's engagement with the sheet 107).

Figure 4A:
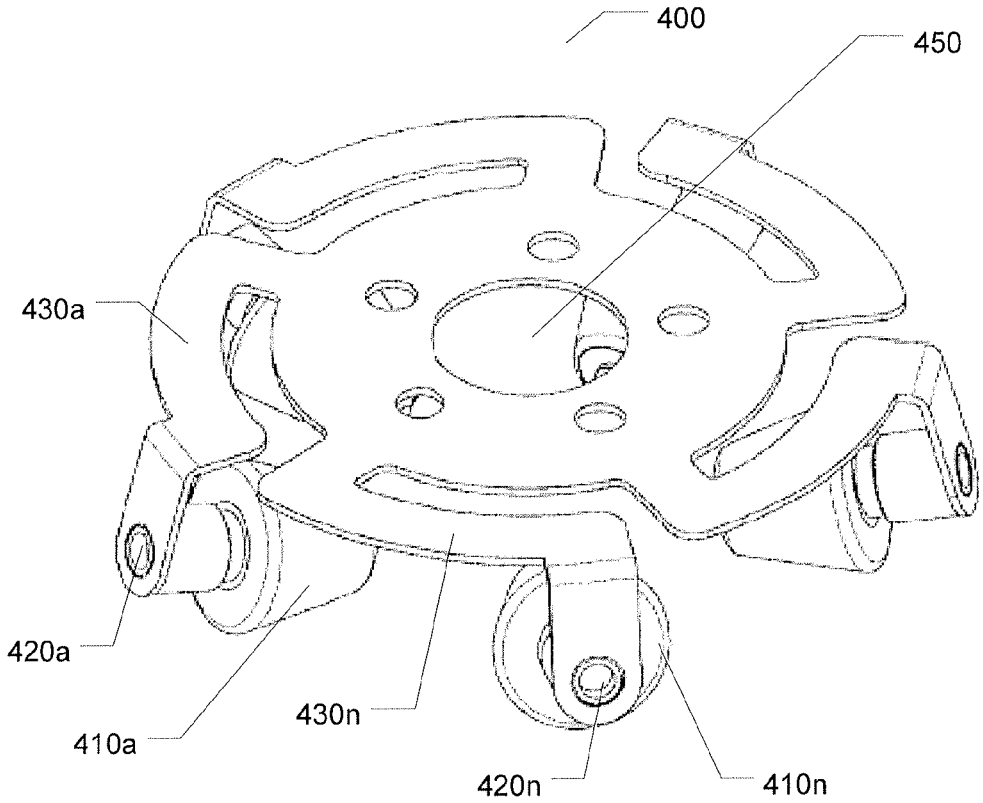
FIG. 4*a* is an isometric view of a roller assembly according to the principles of the present invention.

FIG. 4*a* is an isometric view of a roller assembly according to the principles of the present invention. In the roller assembly 400 of FIG. 4*a*, rollers 410*a-n* are connected to arms 430*a-n* via pins 420*a-n*. Rollers 410*a-n* are capable of rotating about pins 420*a-n*. Arms 430*a-n* are coupled to central section 455. Hub 450 is located in central section 455 and forms a center of rotation. In addition, hub 450 provides an opening for connection of the roller assembly 400 to a motor or other device capable of rotating roller assembly 400 about hub 450. The roller assembly 400 rotates about hub 450.

Figure 4B:
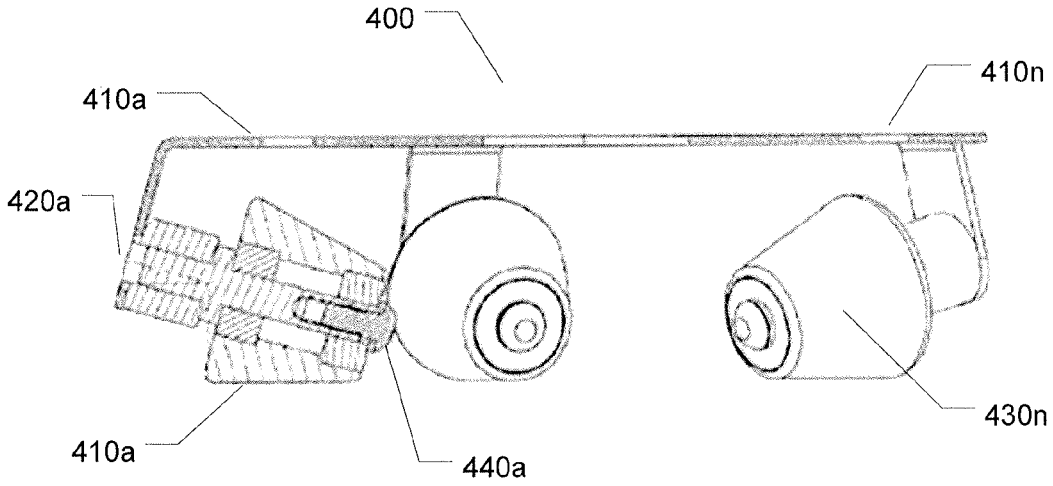
FIG. 4*b* is a side cut away view of the roller assembly of FIG. 4*a* according to the principles of the present invention.

FIG. 4*b* is a side cut away view of the roller assembly of FIG. 4*a* according to the principles of the present invention. In FIG. 4*b*, the interior of roller 410 is depicted. Roller 410*a-n* has hollow bore that receives pin 420*a*. Pin 420*a* is also fixed to arm 430. Roller 410 rotates about pin 420*a*. A cap pin 440*a* retains roller 410 on pin 420*a*. Arms 430*a-n* are bent at an angle of greater than 90 degrees so that the bottom surface of roller 410*a-n* (the surface of roller 410*a-n* that contacts the elastomeric sheet or tubing) is generally parallel to the portion of arm 430*a-n* that is coupled to hub 450. Roller 410*a-n* is generally conical (and more particularly, roller 410*a-n* is shaped like a portion of a cone). As such, the rolling surfaces of roller 410*a-n* are not parallel to (or disposed at an angle with respect to) the pin 420*a-n* and cap pin 440*a-n*.

Figure 4C:
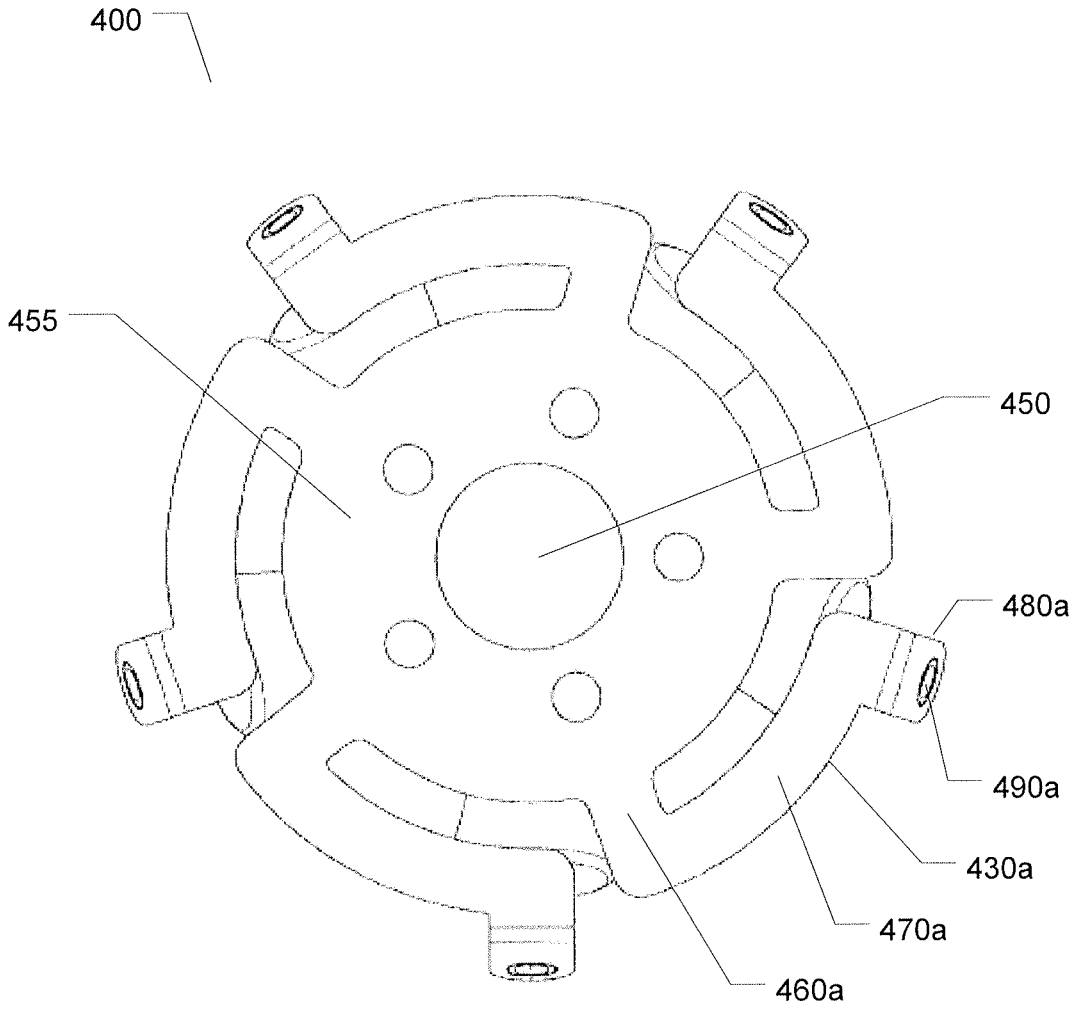
FIG. 4*c* is a top view of the roller assembly of FIG. 4*a* according to the principles of the present invention.

FIG. 4*c* is a top view of the roller assembly of FIG. 4*a* according to the principles of the present invention. In FIG. 4*c*, the configuration of arms 430*a-n* are more clearly shown. As an example, one arm (430*a*) comprises three sections: a radial section 460*a*, an arcuate section 470*a*, and a bent section 480*a*. Bent section 480*a* includes a hole 490*a* for receiving pin 420*a*. Radial section 460*a* connects arcuate section 470*a* with central section 455. The top surfaces of arcuate section 470*a*, radial section 460*a*, and central section 455 are all generally parallel. Arcuate section 470*a* connects radial section 460*a* with bent section 480*a*. Bent section 480*a* is bent at an angle with respect to arcuate section 470*a*. In this example, the angle is greater than 90 degrees so that the rolling surface of roller 410*a* is generally parallel with the surface of arcuate section 470*a* (as shown in FIG. 4*b* for roller 410*a*). A hole 490*a* in bent section 480*a* receives a pin that secures roller 410*a*.

Central section 455, radial section 460, arcuate section 470 and bent section 480 may all be stamped or formed from a single sheet of material. In such a case, arcuate section 470 is capable of flexing up and down with respect to central section 455. Accordingly, arcuate section 470 has a spring constant associated with it. When the roller assembly 400 is engaged with a flexible tubing or cassette, the arcuate section 470 presses the roller 410 firmly against the flexible tubing or cassette. The spring constant associated with arcuate section 470 may be designed such that a desired force is applied by roller 410 on the flexible tubing or cassette. For example, when the arcuate section 470 is formed from a sheet of steel, a thin sheet may be used to provide a small spring constant or a thicker sheet may be used to provide a greater spring constant. In addition, the force applied by arcuate section 470 on roller 410 keeps roller 410 engaged with the flexible tubing or cassette (for example, when the flexible tubing or cassette is uneven due to fluid and material in it).

Figure 5A:
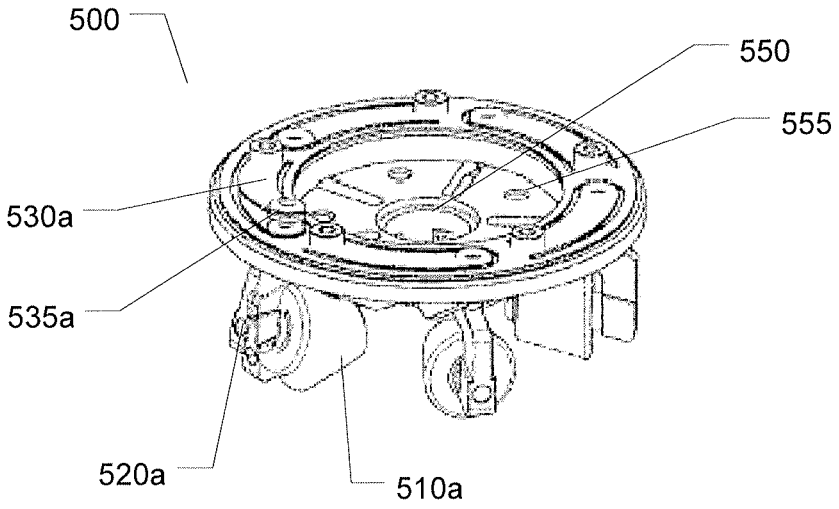
FIG. 5*a* is an isometric view of a roller assembly according to the principles of the present invention.
Figure 5B:
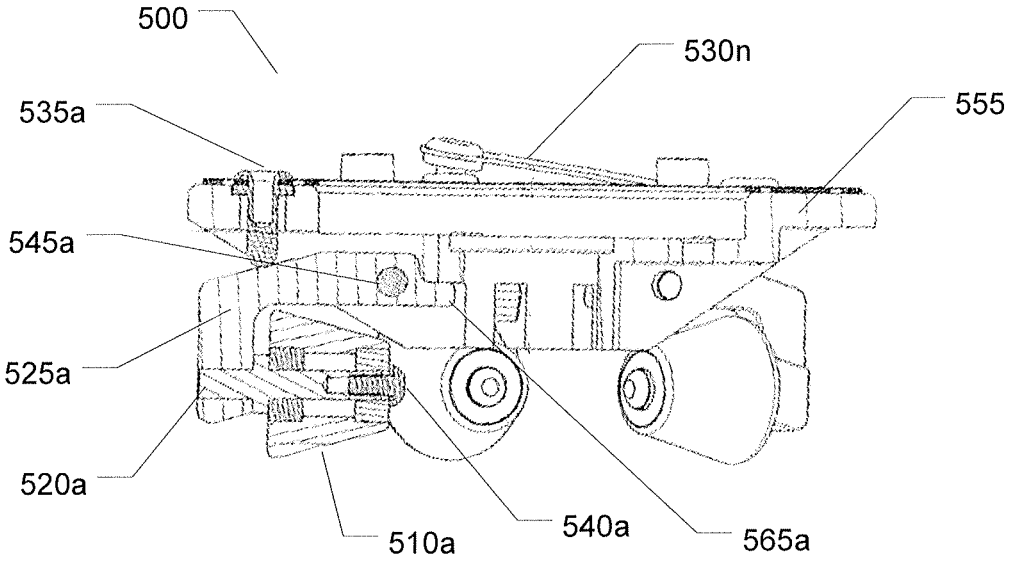
FIG. 5*b* is a side cut away view of the roller assembly of FIG. 5*a* according to the principles of the present invention.

FIG. 5*a* is an isometric view of a roller assembly according to the principles of the present invention. FIG. 5*b* is a side cut away view of the roller assembly of FIG. 5*a* according to the principles of the present invention. The structure and operation of the roller assembly of FIGS. 5*a*-5*b* is similar to that of FIGS. 4*a-c*. In the roller assembly 500 of FIGS. 5*a*-5*b*, rollers 510*a-n* are rotatably connected to arms 525*a-n* via pins 520*a-n*. Accordingly, rollers 510*a-n* are capable of rotating about pins 520*a-n*. Arms 525*a-n* are coupled to central section 555 via pivot 545*a-n*. Hub 550 is located in central section 555 and forms a center of rotation. In addition, hub 550 provides an opening for connection of the roller assembly 500 to a motor or other device capable of rotating roller assembly 500 about hub 550. The roller assembly 500 rotates about hub 550. The structure and configuration of rollers 510*a-n* is the same as that of rollers 410*a-n*.

As more clearly seen in FIG. 5*b*, arm 525*n* pivots about pivot 545*n*. Spring pin 535*n* is coupled to flexible arm 530*n*. Flexible arm 530*n* exerts a force on arm 525*n* via spring pin 535*n*. Stop 565*n* is located at one end of arm 525*n* and rests against a portion of central section 555. The force exerted by flexible arm 530*n* holds stop 565*n* against central section 555, and thus keeps arm 525*n* in a first, unpivoted position. As roller 510*n* is engaged with a polymer sheet or tubing, arms 525*n* can pivot upwards by deflecting flexible arm 530*n*. In this manner, as a force is applied to roller 510*n*, arm 525*n* pivots about pivot 545*n*. As arm 525*n* pivots, it pushes on spring pin 535*n* and deflects flexible arm 530*n*. Flexible arm 530*n* may be designed to provide a suitable force against arm 525*n* via spring pin 535*n*. As such, flexible arm 530*n* may have a spring constant sufficient to keep roller 510*n* pressed securely against a polymer sheet or flexible tubing.

Figure 6A:
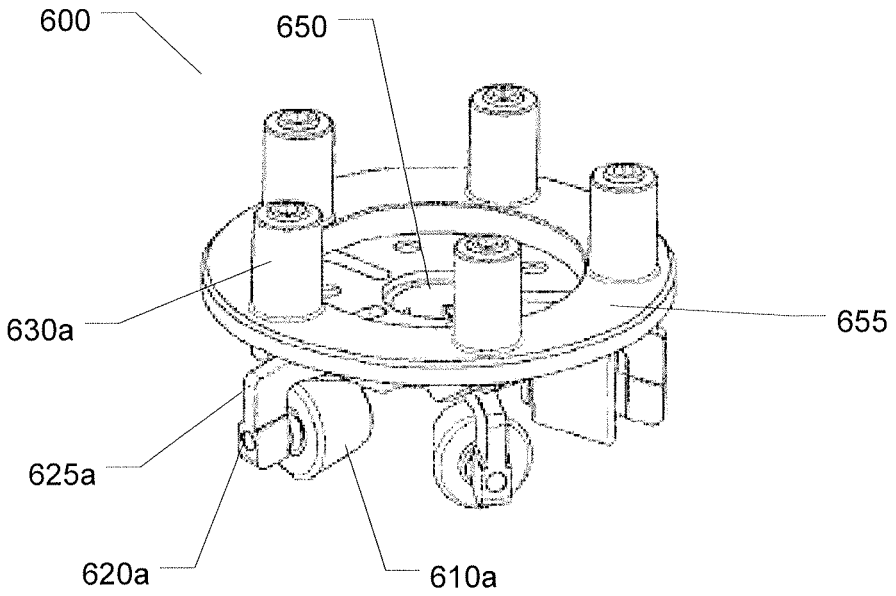
FIG. 6*a* is an isometric view of a roller assembly according to the principles of the present invention.
Figure 6B:
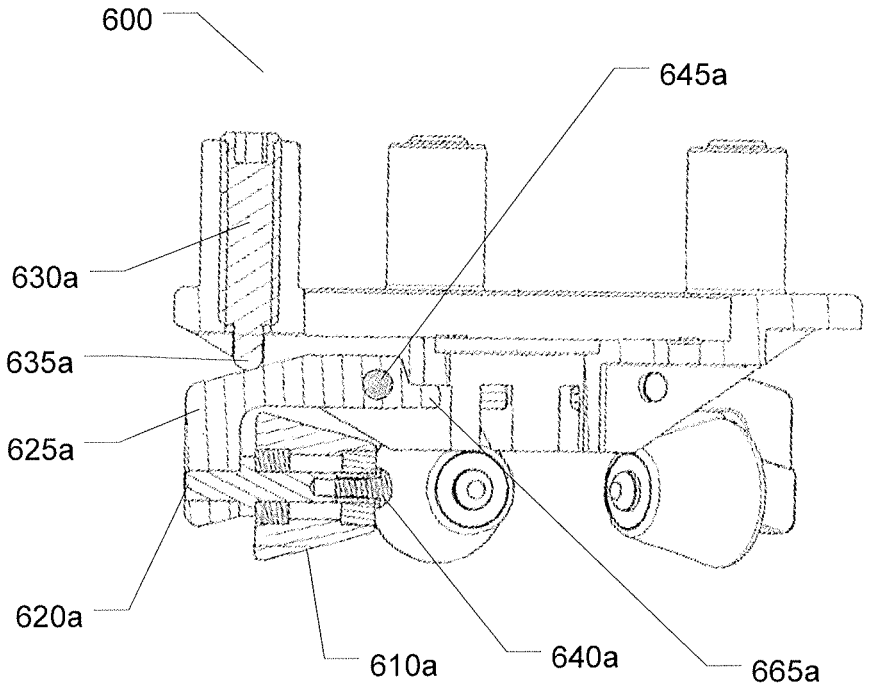
FIG. 6*b* is a side cut away view of the roller assembly of FIG. 6*a* according to the principles of the present invention.

FIG. 6*a* is an isometric view of a roller assembly according to the principles of the present invention. FIG. 6*b* is a side cut away view of the roller assembly of FIG. 6*a* according to the principles of the present invention. The structure and operation of the roller assembly of FIGS. 6*a*-6*b* is similar to that of FIGS. 4*a*-4*c* and 5*a*-5*b*. In the roller assembly 600 of FIGS. 6*a*-6*b*, rollers 610*a-n* are rotatably connected to arms 625*a-n* via pins 620*a-n*. Accordingly, rollers 610*a-n* are capable of rotating about pins 620*a-n*. Arms 625*a-n* are coupled to central section 655 via pivot 645*a-n*. Hub 650 is located in central section 655 and forms a center of rotation. In addition, hub 650 provides an opening for connection of the roller assembly 600 to a motor or other device capable of rotating roller assembly 600 about hub 650. The roller assembly 600 rotates about hub 650. The structure and configuration of rollers 610*a-n* is the same as that of rollers 410*a-n*.

As more clearly seen in FIG. 6*b*, arm 625*n* pivots about pivot 645*n*. Spring assembly 635*n* exerts a force on arm 625*n*. Stop 665*n* is located at one end of arm 625*n* and rests against a portion of central section 655. The force exerted by spring assembly 630*n* holds stop 665*n* against central section 655, and thus keeps arm 625*n* in a first, unpivoted position. As roller 610*n* is engaged with a polymer sheet or tubing, arms 625*n* can pivot upwards by deflecting spring assembly 630*n*. In this manner, as a force is applied to roller 610*n*, arm 625*n* pivots about pivot 645*n*. As arm 625*n* pivots, it pushes on spring assembly 630*n*. Spring assembly 630*n* may be designed to provide a suitable force against arm 625*n*. As such, spring assembly 630*n* may have a spring constant sufficient to keep roller 610*n* pressed securely against a polymer sheet or flexible tubing.

Figure 7A:
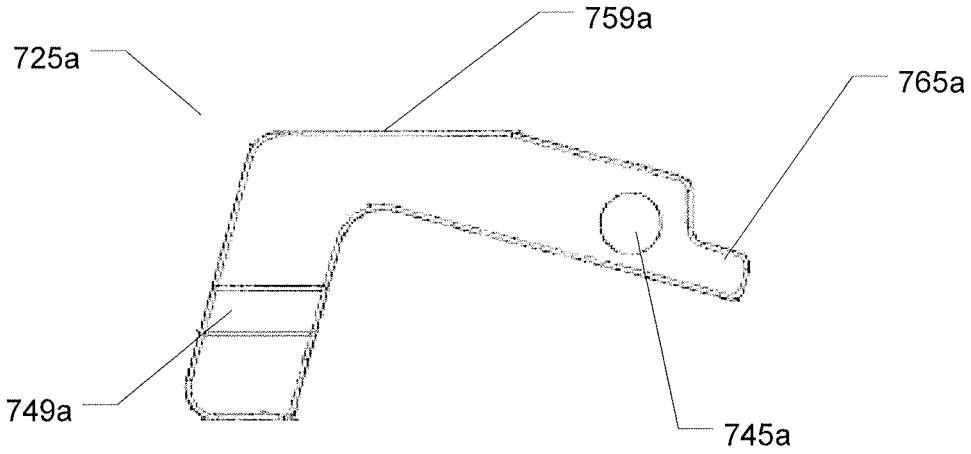
FIG. 7*a* is a side view of an arm of the roller assembly of FIG. 6*a* according to the principles of the present invention.
Figure 7B:
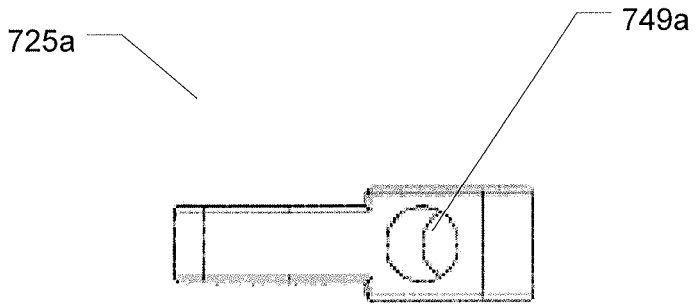
FIG. 7*b* is an end view of an arm of the roller assembly of FIG. 6*a* according to the principles of the present invention.

FIG. 7*a* is a side view of an arm of the roller assembly of FIGS. 5*a*-5*b* and 6*a*-6*b* according to the principles of the present invention. FIG. 7*b* is an end view of an arm of the roller assembly of FIGS. 5*a*-5*b* and 6*a*-6*b* according to the principles of the present invention. Arm 725 has a hole 749*n* that accepts a pin to engage a roller. A pivot hole 745 accepts a pin that allows arm 725 to pivot about pivot hole 745. A stop 765 is located on one end of arm 725. A flat 759 is located on a top end of arm 725. Flat 759 provides a surface for engagement with a spring pin (as in FIGS. 5*a*-5*b*) or spring assembly (as in FIGS. 6*a*-6*b*). FIG. 7*b* more clearly shows the hole 749 that accepts a pin to engage a roller.

Figure 8A:
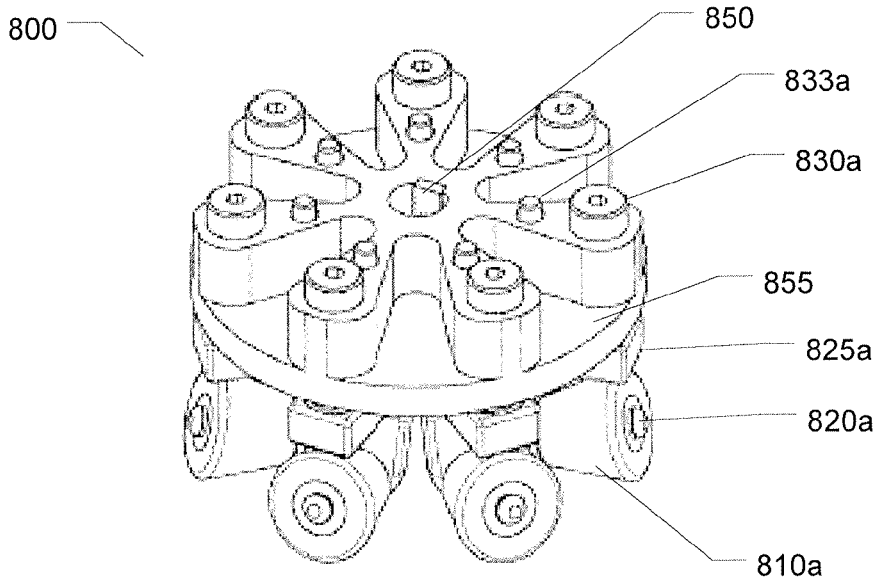
FIG. 8*a* is an isometric view of a roller assembly according to the principles of the present invention.
Figure 8B:
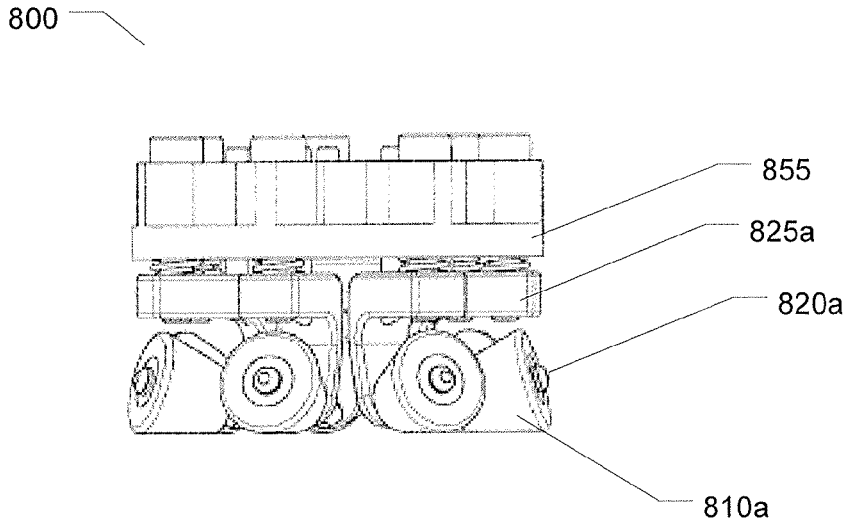
FIG. 8*b* is a side view of the roller assembly of FIG. 8*a* according to the principles of the present invention.
Figure 8C:
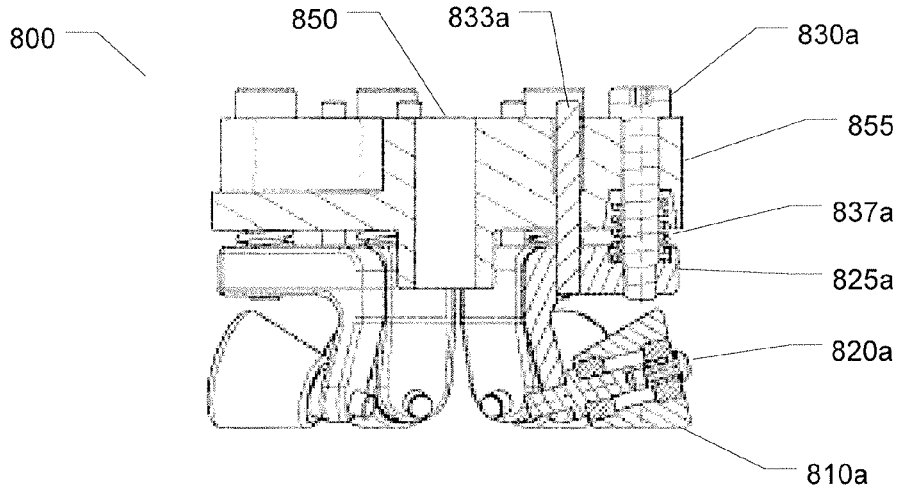
FIG. 8*c* is a side cut away view of the roller assembly of FIG. 8*a* according to the principles of the present invention.

FIGS. 8*a*, 8*b*, and 8*c* are an isometric view, a side view, and a side cut away view (respectively) of a roller assembly according to the principles of the present invention. Roller assembly 800 has a central section 855 with a hub 850, rollers 810*a-n*, pins 820*a-n*, arms 825*a-n*, spring pins 830*a-n*, retaining pins 833*a-n*, springs 837*a-n*, and axles 823*a-n*. Hub 850 is centrally located in central section 855. Roller assembly 800 rotates around hub 850. Rollers 810*a-n* are coupled to arms 825*a-n* by pins 820*a-n*. Each arm 825*a-n* is coupled to a spring pin 830*a-n* and a retaining pin 833*a-n*. One end of spring pin 830*a-n* is secured to arm 825*a-n* and the other end of spring pin 830*a-n* terminates in a cap that rests on top of central section 855. Spring pin 830*a-n* is located in and can move up and down in a bore in central section 855. Similarly, one end of retaining pin 833*a-n* is secured to arm 825*a-n* and the other end of retaining pin 833-*n* terminates on top of central section 855. Retaining pin 833*a-n* is located in and can move up and down in a bore in central section 855. Movement of arm 825*a-n* is constrained by retaining pin 833*a-n*. Arm 825*a-n* can only move up and down along retaining pin 833*a-n*. A spring 837*a-n* is located between arm 825*a-n* and central section 855. One end of spring 837*a-n* is contained in a bore in central section 855, and the other end of spring 837*a-n* is contained in a bore in arm 825*a-n*. In this manner, spring 837*a-n* exerts a force that separates central section 855 from arm 825*a-n*.

Roller 810*a-n* is arranged such that the surface of roller 810*a-n* that contacts a polymer sheet or tubing is generally parallel to a surface of central section 855. In this manner, substantially all of the roller surface of roller 810*a-n* makes contact with the polymer sheet or tubing as the roller 810*a-n* moves. Because of retaining pin 833*a-n*, roller 810*a-n* moves only up and down with respect to central section 855. As roller 810*a-n* moves up and down, retaining pin 833*a-n* slides in a bore in central section 855. Spring 837*a-n* presses down on arm 825*a-n* (and attached roller 810*a-n*). As such, spring 837*a-n* biases arm 825*a-n* away from central section 855. The structure and configuration of rollers 810*a-n* is the same as that of rollers 410*a-n*.

Figure 9:
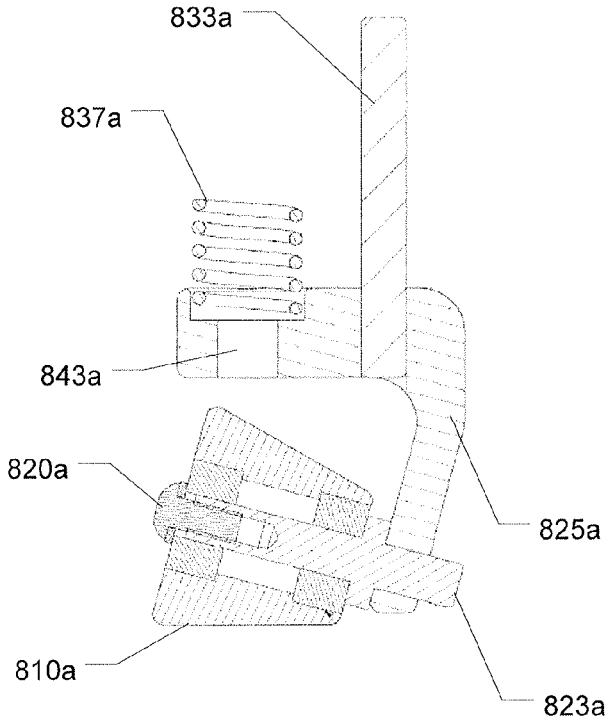
FIG. 9 is a side cut away view of a single roller head and arm assembly of the roller assembly of FIG. 8*a* according to the principles of the present invention.

FIG. 9 is a side cut away view of a single roller head and arm assembly of the roller assembly of FIG. 8*a* according to the principles of the present invention. In FIG. 9, retaining arm 833*a-n* is secured to arm 825*a-n*. An axle 823*a-n* is also secured to arm 825*a-n*. Roller 810*a-n* is secured to axle 823*a-n* by pin 820*a-n* and rotates about axle 823*a-n*. The location of spring 837*a-n* is also show with respect to arm 825*a-n*. A recess 843*a-n* receives spring pin 830*a-n*.

Figure 10:
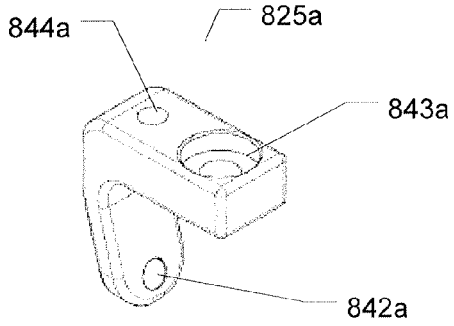
FIG. 10 is a side view of an arm of the roller assembly of FIG. 8*a* according to the principles of the present invention.

FIG. 10 is a side view of an arm of the roller assembly of FIG. 8*a* according to the principles of the present invention. In FIG. 10, arm 825*a-n* has a hole 842*a-n* for receiving axle 823*a-n*, a hole 844*a-n* for receiving retaining pin 833*a-n*, and a recess 843*a-n* for receiving spring pin 833*a-n*.

Figure 11A:
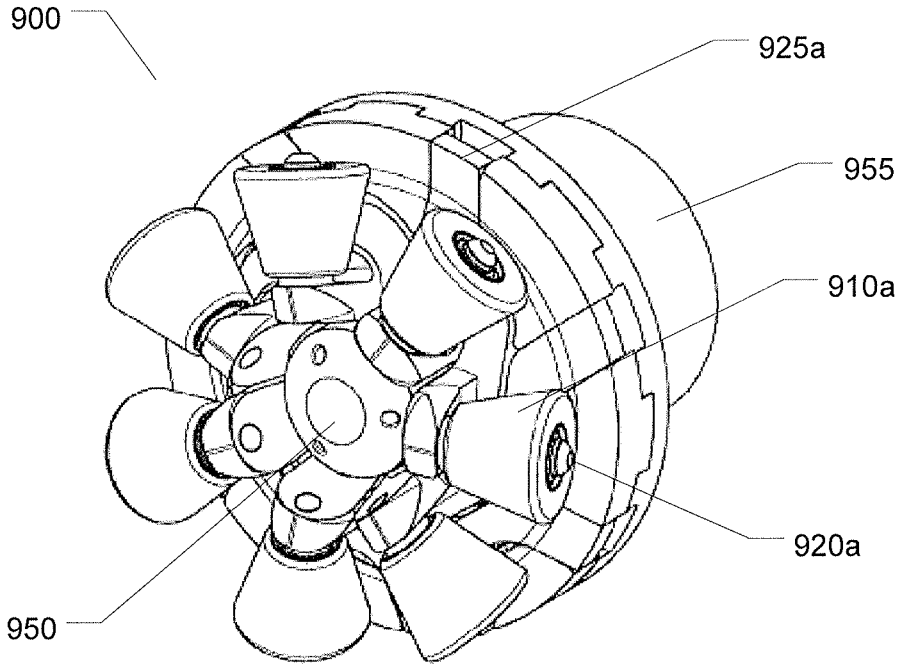
FIG. 11*a* is an isometric view of a roller assembly according to the principles of the present invention.

FIGS. 11*a*-11*d* are various isometric views of a roller assembly according to the principles of the present invention. In FIGS. 11*a*-11*d*, roller assembly 900 has a central section 955. A hub 950, rollers 910*a-n*, pins 920*a-n*, arms 925*a-n*, pivots 930*a-n*, axles 923*a-n*, springs 937*a-n*, pivot pins 942*a-n* and 944*a-n*, roller arm ends 926*a-n*, hub bore 957, and spring bores 956*a-n*. In FIG. 11*a*, rollers 910*a-n* are held to arms 925*a-n* by pins 920*a-n*. Arms 825*a-n* are coupled to central section 955 such that arms 925*a-n* can pivot with respect to central section 955. A hub 950 is located at the center of central section 955. Roller assembly 900 rotates about hub 950. Rollers 910*a-n* are oriented such that the rolling surface of rollers 910*a-n* contact a polymer sheet or flexible tubing during a peristaltic pumping process.

Figure 11B:
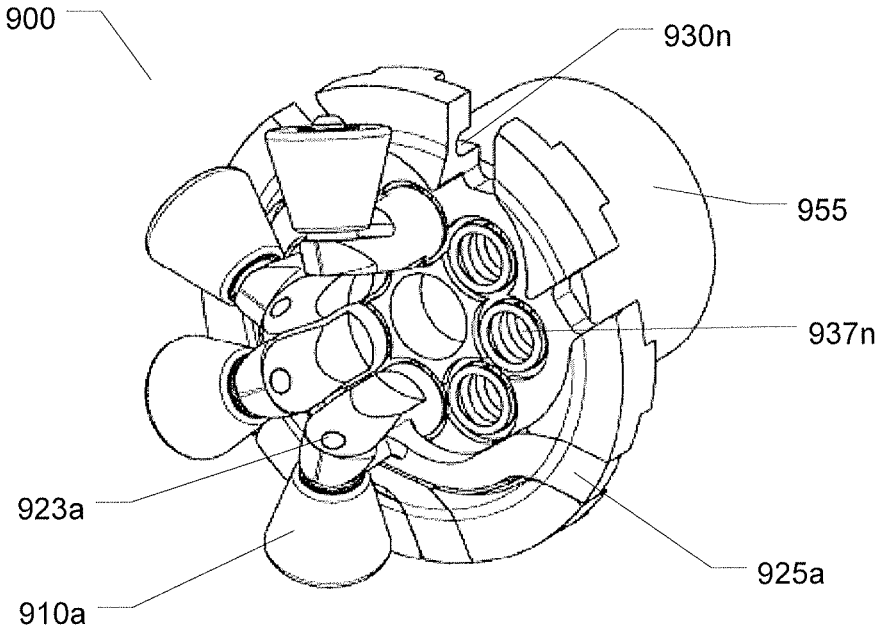
FIG. 11*b* is a partial isometric view of the roller assembly of FIG. 11*a* according to the principles of the present invention.

As more clearly shown in FIG. 11*b*, rollers 910*a-n* are connected to arms 925*a-n* via axles 923*a-n* and pins 920*a-n*. Springs 937*a-n* are located in central section 955 beneath rollers 910*a-n* (more particularly beneath arms 925*a-n* that couple to rollers 910*a-n*). Pivots 930*a-n* provide an attachment location for arms 925*a-n*. Arms 925*a-n* are attached to central section 955 at pivots 930*a-n*. Arms 925*a-n* pivot with respect to central section 955 at pivots 930*a-n*. The structure and configuration of rollers 910*a-n* is the same as that of rollers 410*a-n*.

Figure 11C:
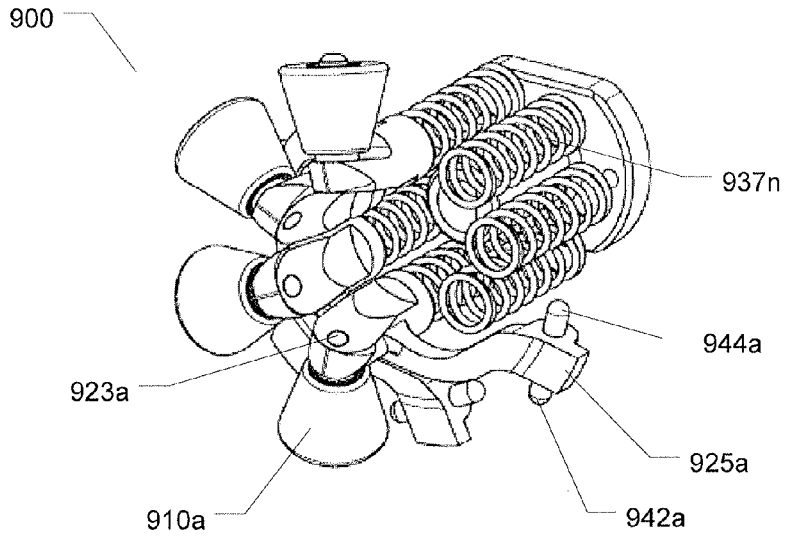
FIG. 11*c* is a partial isometric view of the roller assembly of FIG. 11*a* according to the principles of the present invention.

FIG. 11*c* more clearly shows the structure of arms 925*a-n* and the location of springs 937*a-n*. In FIG. 11*c*, arms 925*a-n* each have two pivot pins 942*a-n* and 944*a-n*. The pivot pins, 942*a-n* and 944*a-n*, fit into pivots 930*a-n* of central section 955. In this manner, the pivot pins, 942*a-n* and 944*a-n*, each fit into the recesses that define the pivots 930*a-n* in central section 955. Pivot pins, 942*a-n* and 944*a-n*, couple arms 910*a-n* to central section 955. Springs 937*a-n* are located beneath arms 925*a-n* and provide a spring force that biases arms 925*a-n* upward. Hub 950 engages a hub engaging surface 968*a-n* (in FIG. 12*a*) that retains arms 925*a-n*.

Figure 11D:
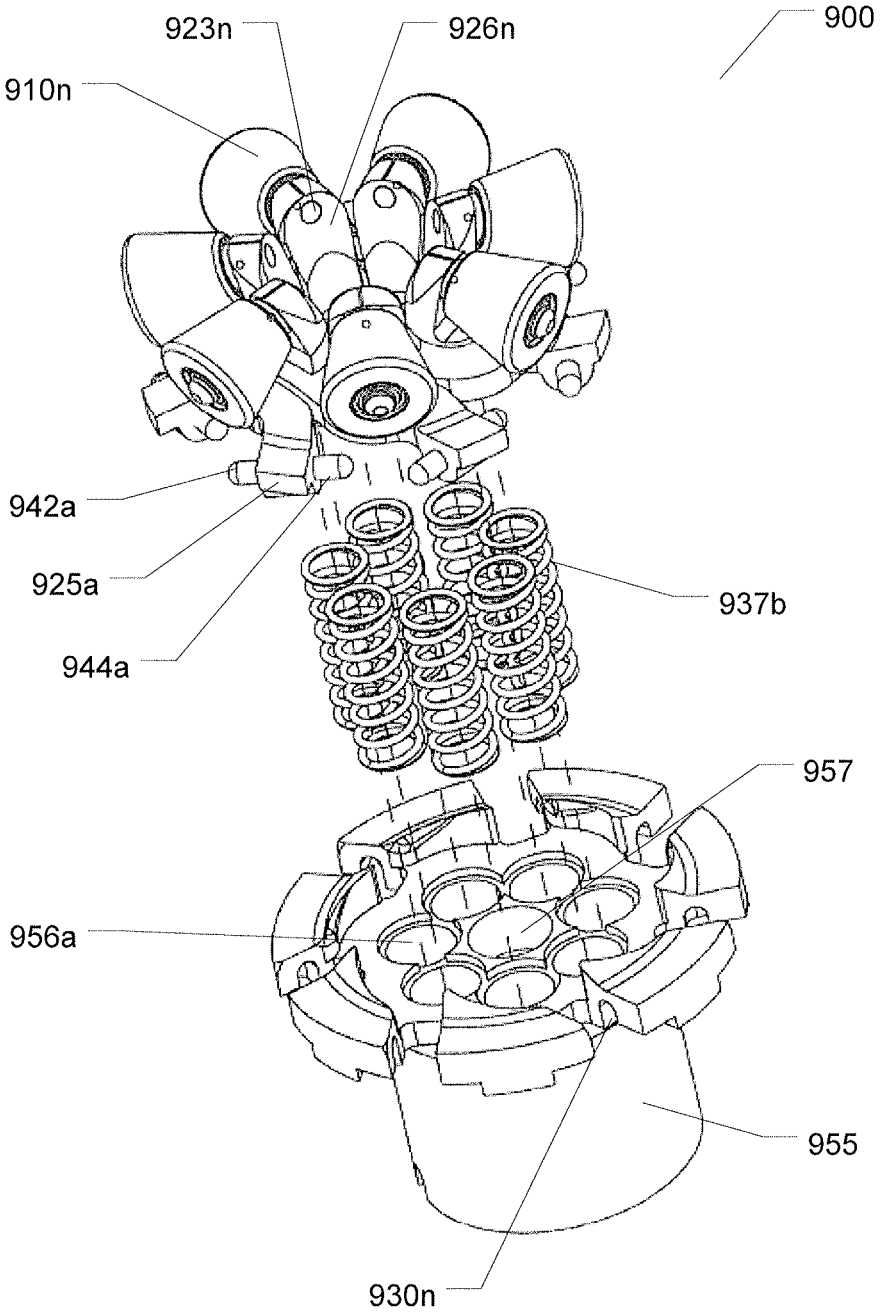
FIG. 11*d* is an expanded isometric view of the roller assembly of FIG. 11*a* according to the principles of the present invention.

FIG. 11*d* shows how the arms 925*a-n*, springs 937*a-n*, and central section 955 fit together. Central section 955 has a hub bore 957 that receives hub 950, and spring bores 956*a-n* that receive springs 937*a-n*. In addition, central section 955 also has a pair of pivots 930*a-n* for each arm 925*a-n*. Each arm 925*a-n* has a spring 937 associated with it. Springs 937*a-n* fit into spring bores 956*a-n*. Springs 937*a-n* are retained in spring bores 956*a-n* by a back surface of central section 955 (shown in FIG. 11*c*) and hub 950 (which presses arms 925*a-n* against springs 937*a-n* and serves to retain arms 937*a-n*). Pivot pins 942*a-n* and 944*a-n* fit into pivots 930*a-n* in central section 955.

Figure 12A:
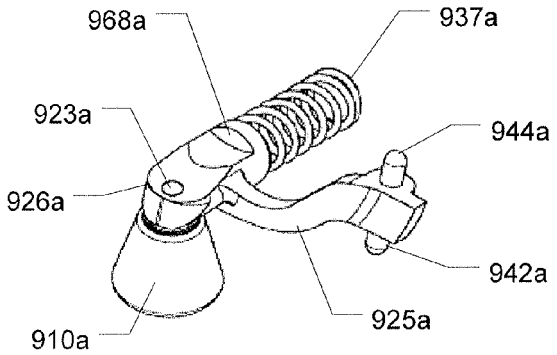
FIG. 12*a* is an isometric view of an arm of the roller assembly of FIG. 11*a* according to the principles of the present invention.
Figure 12B:
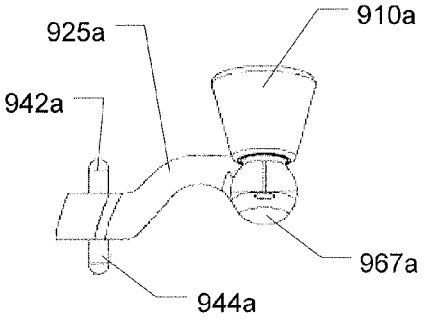
FIG. 12*b* is an isometric view of an arm of the roller assembly of FIG. 11*a* according to the principles of the present invention.
Figure 12C:
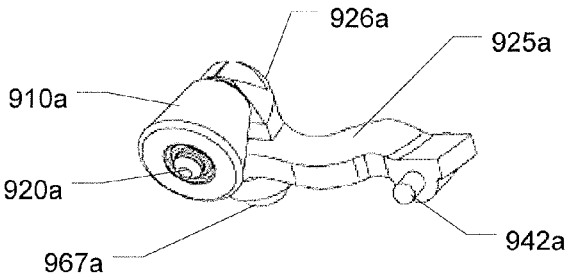
FIG. 12*c* is an isometric view of an arm of the roller assembly of FIG. 11*a* according to the principles of the present invention.

FIGS. 12*a*-12*c* are various isometric views of an arm of the roller assembly of FIGS. 11*a*-11*d* according to the principles of the present invention. Arms 925*a-n* have a pair of pivot pins 942*a-n* and 944*a-n*, a spring coupling surface 967*a-n*, a hub retaining surface 968*a-n*, and a roller arm end 926*a-n*. Rollers 910*a-n* are coupled to arms 925*a-n* at the roller end 926*a-n*. Axles 923*a-n* are fixed to roller arms end 926*a-n*. Rollers 910*a-n* are held on axles 923*a-n* by pins 920*a-n*. Each arm 925*a-n* has a pivot end that couples the arm to the central section 955. Arm 925*a-n* has a generally curved or arcuate profile such that the roller end 926*a-n* and pivot end (end on which pivots 942*a-n* and 944*a-n* reside) are arranged to couple the arm 925*a-n* to the central section 955 and to allow for proper alignment of roller 910*a-n*. Generally, the pivot end of arm 925*a-n* is at least one roller width distance from the roller end 926*a-n* of arm 925*a-n*. In addition, the roller end 926*a-n* of the arm 925*a-n* is located a distance away in two different directions from the pivot end of the arm 925*a-n*. In this manner, arm 925*a-n* is curved with respect to two different planes. With the pivot end fixed to a periphery of the central section 955, the roller end 926*a-n* of arm 925*a-n* is located interior to the periphery of central section 955 and above central section 955.

Each arm 925*a-n* has a spring coupling surface 967*a-n* associated with it. The spring coupling surface 967*a-n* rests against spring 937*a-n*. Spring coupling surface 967*a-n* has a lip that receives an end of spring 937*a-n*. Arms 925*a-n* is configured such that a surface of roller 910*a-n* contacts a polymer sheet or flexible tubing during the entire travel of arm 925*a-n* (as arm 925*a-n* pivots with respect to central section 955). Springs 937*a-n* bias arms 925*a-n* away from central section 955. As rollers 910*a-n* encounter variations in a polymer sheet or flexible tubing, rollers 925*a-n* are pressed towards central section 955 thus compressing spring 937*a-n*. In this manner, rollers 910*a-n* are held tightly against a polymer sheet or flexible tubing by springs 937*a-n*. Because of the shape of arms 925*a-n* and the distance between the rollers 910*a-n* and the pivots 930*a-n*, rollers 910*a-n* are held against a polymer sheet or flexible tubing such that a surface of rollers 910*a-n* press firmly against the polymer sheet or flexible tubing. The rolling surface of rollers 910*a-n* remains general parallel to the polymer sheet or flexible tubing throughout travel of the arms 925*a-n*.

Regardless of the embodiment described above, the rollers are biased against a polymer sheet or flexible tube such that the rolling surface of the rollers presses against the polymer sheet or flexible tube. The rolling surface of the rollers (i.e. the surface that contacts the polymer sheet or flexible tube) is generally parallel to the polymer sheet or flexible tube so as to press against it. The rollers are maintained against the polymer sheet or flexible tube by a spring force so as to provide peristaltic pumping as the roller assembly rotates.

From the above, it may be appreciated that the present invention provides an improved peristaltic pump system. The present invention provides independent roller heads for use with a peristaltic pump system. The present invention is illustrated herein by example, and various modifications may be made by a person of ordinary skill in the art.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A roller assembly comprising:

a central section with a hub, the central section having a plurality of pivots located around the central section and the roller assembly rotating about the hub on a rotation axis of the hub, wherein the plurality of pivots are located around a periphery of the central section:

a plurality of arms, each arm having a roller end and a pivot end, the pivot ends coupled to the central section at the plurality of pivots such that each arm is capable of pivoting independently with respect to the central section, the roller ends and pivot ends of each arm located a distance of at least one roller width away from each other;

a plurality of rollers, one roller coupled to each of the roller ends of the plurality of arms, wherein the rollers are located interior the periphery of the central section:

wherein the plurality of rollers and arms are located around the central section such that the pivot is located a distance away from the roller; and wherein a rotational axis of each roller is perpendicular to the rotation axis of the hub.

2. The roller assembly of claim 1 wherein each roller is coupled to each arm via an axle and a pin.

3. The roller assembly of claim 1 wherein a rolling surface of the rollers is generally parallel with a flat surface of the central section.

4. The roller assembly of claim 1 further comprising a plurality of springs wherein a spring is located adjacent to each roller.

5. The roller assembly of claim 4 wherein the plurality of springs is located in a plurality of spring bores in the central section.

6. The roller assembly of claim 4 wherein each arm further comprises a hub retaining surface and a spring coupling surface located near the roller arm end of the arm.

7. The roller assembly of claim 1 wherein each arm further comprises a pair of pivot pins, the pair of pivot pins coupling the arm to the central section at the pivot.

8. The roller assembly of claim 7 wherein the spring coupling surface contacts the spring.

9. The roller assembly of claim 7 wherein the hub retaining surface contacts the hub such that the hub retains the arm adjacent to the central section.

10. The roller assembly of claim 1 wherein when an arm pivots, a roller surface of the roller coupled to the arm is generally parallel to a surface of the central section.

11. The roller assembly of claim 1 wherein a rolling surface of the rollers is arranged to engage a polymer sheet or flexible tubing throughout a range of travel of the arms.

12. A roller assembly comprising:

a central section with a hub, the central section having a plurality of pivots located around the central section and the roller assembly rotating about the hub on a rotation axis of the hub;

a plurality of arms, each arm having a roller arm end and a pivot end, the pivot ends coupled to the central section at the plurality of pivots such that each arm is capable of pivoting independently with respect to the central section, the roller arm ends and pivot ends of each arm located a distance of at least one roller width away from each other;

a hub retaining surface and a spring coupling surface located near the roller arm end of the arm;

a plurality of rollers, one roller coupled to each of the roller ends of the plurality of arms, wherein the rollers are located interior a periphery of the central section; and a plurality of springs, one spring located adjacent to each roller;

wherein the plurality of rollers and arms are located around the central section such that the pivot is located a distance away from the roller, the spring coupling surface contacts the spring, and the hub retaining surface contacts the hub such that the hub retains the arm adjacent to the central section; and wherein a longitudinal rotational axis of each roller is perpendicular to the rotation axis of the hub.

13. The roller assembly of claim 12 wherein each roller is coupled to each arm via an axle and a pin.

14. The roller assembly of claim 12 wherein a rolling surface of the rollers is generally parallel with a flat surface of the central section.

15. The roller assembly of claim 12 wherein the plurality of springs is located in a plurality of spring bores in the central section.

16. The roller assembly of claim 12 wherein each arm further comprises a pair of pivot pins, the pair of pivot pins coupling the arm to the central section at the pivot.

17. The roller assembly of claim 12 wherein when an arm pivots, a roller surface of the roller coupled to the arm is generally parallel to a surface of the central section.

18. The roller assembly of claim 12 wherein the plurality of pivots are located around a periphery of the central section.

19. The roller assembly of claim 12 wherein a rolling surface of the rollers is arranged to engage a polymer sheet or flexible tubing throughout a range of travel of the arms.

* * * * *

UNITED STATES PATENT AND TRADEMARK OFFICE

CERTIFICATE OF CORRECTION

PATENT NO. : 9,291,159 B2
APPLICATION NO. : 13/905221
DATED : March 22, 2016
INVENTOR(S) : Vincent A. Baxter It is certified that error appears in the above-identified patent and that said Letters Patent is hereby corrected as shown below:

On the Title Page and in the Specification, Column 1 in the title of the invention, please change "PICOTING" to --PIVOTING--.

Signed and Sealed this
Thirty-first Day of May, 2016

Michelle K. Lee

Michelle K. Lee
*Director of the United States Patent and Trademark Office*